US006191734B1

(12) United States Patent
Park et al.

(10) Patent No.: US 6,191,734 B1
(45) Date of Patent: Feb. 20, 2001

(54) SATELLITE TRACKING APPARATUS AND CONTROL METHOD FOR VEHICLE-MOUNTED RECEIVE ANTENNA SYSTEM

(75) Inventors: Chan Goo Park; Soon Ik Jeon; Seong Pal Lee, all of Taejon (KR)

(73) Assignee: Electronics and Telecommunications Research Institute, Taejon (KR)

( * ) Notice: Under 35 U.S.C. 154(b), the term of this patent shall be extended for 0 days.

(21) Appl. No.: 09/432,767

(22) Filed: Nov. 3, 1999

(30) Foreign Application Priority Data

Mar. 18, 1999 (KR) ..... 99-9168

(51) Int. Cl.[7] ..... H01Q 3/00
(52) U.S. Cl. ..... 342/359
(58) Field of Search ..... 342/81, 354, 359, 342/422, 75

(56) References Cited

U.S. PATENT DOCUMENTS

| | | | | |
|---|---|---|---|---|
| 4,994,812 | | 2/1991 | Uematsu et al. | 342/359 |
| 5,089,824 | * | 2/1992 | Uematsu et al. | 342/359 |
| 5,166,693 | | 11/1992 | Nishikawa et al. | 342/422 |
| 5,241,319 | * | 8/1993 | Shimizu | 342/358 |
| 5,521,604 | * | 5/1996 | Yamashita | 342/359 |
| 5,592,176 | * | 1/1997 | Vickers et al. | 342/359 |

OTHER PUBLICATIONS

"Development and field experiments of phased array antenna for land vehicle satellite communications" by Kazuo Sato et al., pp. 1073–1075.

"Antenna and tracking system for land vehicles on satellite communications" by Kenji Tanaka et al., IEEE 0–7803–0673–2/92, pp. 7878–7882.

* cited by examiner

*Primary Examiner*—Thomas H. Tarcza
*Assistant Examiner*—Dao L. Phan
(74) *Attorney, Agent, or Firm*—Antonelli, Terry, Stout & Kraus, LLP

(57) ABSTRACT

The present invention relates to a satellite tracking apparatus and control method for performing attitude control of a vehicle-mounted antenna for receiving a satellite broadcasting and operating the antenna. The present invention employs a hybrid tracking method that performs tracking using an electronic beam in an elevation direction while performing mechanical tracking in an azimuth direction. The electronic tracking is employed in controlling the azimuth direction to compensate for a tracking error in the azimuth direction. While the tracking performance of the present invention is similar to that of the full-electronic antenna, the present invention achieves better beam efficiency by arranging radiating elements to be effective in front of the antenna, thereby realizing a high gain antenna.

14 Claims, 10 Drawing Sheets

SATELLITE TRACKING APPARATUS AND CONTROL METHOD FOR VEHICLE-MOUNTED RECEIVE ANTENNA SYSTEM

BACKGROUND OF THE INVENTION

1. Field of the Invention

The present invention relates to a satellite tracking apparatus and control method for performing attitude control of a vehicle-mounted antenna for receiving a satellite broadcasting (or satellite communication receiving signals) and operating the antenna and more particularly to a satellite tracking apparatus and control method for quickly and accurately tracking a satellite in accordance with a moving direction of a vehicle with an antenna mounted to the vehicle, using an electronic tracking method and a mechanical tracking method.

2. Description of Related Art

To receive signals from a satellite, an antenna mounted to a mobile should be directed toward the satellite. For such purpose, an appropriate satellite tracking means is required. Typically, there are an open-loop tracking method using a sensor, a closed-loop tracking method using signals received from a satellite, and a hybrid tracking method employing both methods.

A step track method and a monopulse method are representative methods which search and hold a satellite using signals from the satellite. The open-loop tracking method is characterized by using a geomagnetic compass and a sensor such as a rate sensor.

Since airplanes and ships are usually equipped with navigation systems such as the navy navigation satellite system (NNSS) and the inertial navigation system (INS), the open-loop tracking method is usually employed. However, since signals may be blocked by tunnels or buildings, land vehicles employ the hybrid tracking method using the step track or monopulse method and an angle sensor together.

A conventional satellite tracking method comprises an initial satellite search mode, a tracking mode, and a blocking processing mode (or iterative tracking mode). In the initial satellite search mode, an antenna or beam is turned all around to detect a direction with a maximum signal level. In the tracking mode, a satellite is continuously tracked using a signal level, a monopulse phase signal, or data on vehicle's turning angle when the signal level exceeds a predetermined limit. In the blocking processing mode (or iterative tracking mode), the direction pointed to the satellite is maintained by using the data of a vehicle's turning angle sensor when signals of the satellite cannot be received because the vehicle is passing through a tunnel or buildings block the signals.

A conventional vehicle-mounted Ku-band satellite broadcasting receive antenna uses a pointing error, an azimuth obtained from a gyroscope, and AGC voltage when tracking a satellite. In an initial stage of searching the satellite, an azimuth is increased by 1° while monitoring a receiving level represented by the AGC voltage and, when the signal level exceeds a limit value, Lo, a tracking operation is carried out. In the tracking operation, a pointing error is calculated using a monopulse phase difference and gyro data. If the receiving level is smaller than the limit value, Lo, a gyro control process is performed. Gyro data obtained from gyro control process is read and compared with a value of the receiving level just before the receiving level decreases, for calculating the pointing error of the antenna, thus maintaining a previous attitude of the antenna. Until a value of a timer exceeds a predetermined time, To, the procedure goes to the tracking process. If the receiving level is not restored to To, the procedure goes to a search process.

U.S. Pat. No. 449,671 discloses a vehicle-mounted Ku-band satellite broadcasting receive antenna similar to the above conventional art. It has been developed to accurately detect a pointing error by eliminating errors contained in an error signal obtained from a monopulse of the prior art. Obtaining a ratio of phase error signals represented by a sine and a cosine eliminates the error. Mean square values of a monopulse sine and phase error signal, an absolute error signal by a ratio of the mean square values, and gyro sensor data are used for the satellite tracking. In an initial satellite search process, if the mean square value is equal to or smaller than a predetermined limit value, the antenna is turned round for a given time. If the mean square value exceeds the predetermined value, the scanning is stopped and a peak detection is started. During the peak detection performed after the scanning of the antenna, a mean square is read and compared with the previous value. If the current value is larger than the previous one, the antenna is turned in a current direction. If not, the antenna is turned in an opposite direction, thereby directing the antenna to an orientation. The gyro data is then reset and angle data is read from the absolute error signal. After control the antenna, if a mean square value exceeds the predetermined limit value, consistency of the antenna to the orientation is determined high. After resetting the gyro data, a pointing error is obtained based upon the gyro data. In the blocking process, if the mean square value is smaller than the specified limit value indicating signal blocking, the pointing error in the gyro data is read to control the antenna. If the mean square exceeds the predetermined limit value, the antenna is controlled based upon an error signal.

U.S. Pat. No. 5,166,693 is provided for L-band mobile satellite communication. In this patent, satellite tracking control comprises search of satellite direction, on-turning beam control, on-nonturning beam control, and on-blocking beam control. A receiving level is read and compared with a switching level. If the receiving level is lower than the switching level, it is compared with a blocking level. If the receiving level is lower than the blocking level, the procedure goes to a blocking mode to perform the tracking based upon an angle obtained by an angle sensor. If the receiving level is equal to or higher than the blocking level, an angle obtained by the angle sensor is read and compared with the previous value to determine a state of turn. During the satellite search, a receiving level is read after changing the direction of a beam. If the receiving level exceeds a maximum receiving level, it is memorized as a new maximum receiving level and a current direction of the beam is memorized. Thereafter, scanning is performed in all direction. During the onblocking beam control, data of the angle sensor is read to determine a turning angle. If the turning angle exceeds a reference angle, the beam is changed to an adjacent beam and then a receiving level is read. If the receiving level is equal to or higher than that the switching level, it is maintained. If the receiving level is lower than the switching level, a timer is checked. Until a predetermined time has passed, the previous steps are repeated. Thereafter, the procedure goes to a satellite search mode. During the on-nonturning beam control, if the receiving level is higher the blocking level and lower than the switching level, the beam is changed to a leftward adjacent beam. A receiving level detected after changing the beam is compared with the previous level. If the current level exceeds the previous one, left turn is determined. If not, the beam is changed to a rightward adjacent beam. A current receiving level is then compared with the previous receiving level. If the current level exceeds the previous one, the current receiving level is read and compared with the switching level. If not, the beam is returned to an original direction. During the on-turning beam control, the direction of turn is determined and the beam is scanned. A current receiving level is compared with the previous level. If the current level exceeds the previous level, the current receiving level is read and compared with the switching level. If not, the beam is returned to the original direction.

The following problems occur when such satellite tracking method using the conventional vehicle-mounted antenna is actually applied to a vehicle-mounted satellite broadcasting receive antenna system.

(1) When an azimuth is only mechanically controlled according to the monopulse track method corresponding to the closed-loop tracking method, rapid and accurate control cannot be achieved with the conventional techniques.

(2) It is difficult to implement a satellite antenna tracking system of high gain required for satellite reception since beam efficiency decreases in a full-electronic tracking method. Besides, the structure is complicated.

(3) When a vehicle changes its moving direction with a large pointing error, it is difficult to realize an accurate capture for a short search time when searching the direction of a satellite.

(4) In case of an array antenna employing a hybrid antenna system, a beam steering controller function is installed in a rotating body and a fixed body includes a central processing unit carrying out a main algorithm. Therefore, serial data communication and control is achieved through a rotary joint. This makes rapid control impossible.

(5) When mechanically controlling an azimuth and using a step motor, power efficiency with respect to a torque is low and high cost is required although control is conveniently carried out. When using a direct current servo motor for the control of the azimuth instead, a response characteristic becomes unstable during general rapid response control while the response characteristic becomes slow during stable control. Consequently, it is difficult to achieve stable and rapid response control.

SUMMARY OF THE INVENTION

Accordingly, the present invention is directed to a satellite tracking apparatus and control method for a vehicle-mounted receive antenna system that substantially obviates one or more of the limitations and disadvantages of the related art.

An objective of the present invention is to provide improved satellite tracking and control overcoming the defects of the conventional techniques.

Additional features and advantages of the invention will be set forth in the following description, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a satellite tracking control system for vehicle-mounted receive antenna systems, comprises a radome, a rotating part for receiving satellite signals while rotating for satellite tracking, and a fixed part connected to the rotating part by a rotary joint, for controlling the satellite tracking of the rotating part using a motor control and satellite tracking section for the satellite tracking. The rotating part comprises a radiating and active channel section for receiving the satellite signal via the radome, a power combiner and beam forming section for detecting a main beam signal and a tracking beam signal from an output signal of the radiating and active channel section, a frequency converter for converting the main beam signal of the power combiner and beam forming section into a signal of a frequency band suitable for reception of satellite broadcasting to provide a satellite broadcasting receiving signal, a tracking signal converter for detecting a tracking beam strength signal based upon a tracking beam signal of the power combiner and beam forming section, an angular rate sensor for sensing an absolute angular rate of the rotating part, and a beam steering control section for receiving an angular rate sensing signal, the tracking beam strength signal, and a control signal of the fixed part for motor control and satellite search, generating a channel selection control signal for selecting a channel to be tracked to the tracking signal converter for controlling a tuner for channel selection installed within the tracking signal converter, and generating a tracking beam control signal to the power combiner and beam forming section and a phase control signal to the radiating and active channel section.

The beam steering control section is designed to perform a tracking beam control function, a tracking signal strength detection function, a phase shifter control function, and a function of carrying out a self-algorithm for the satellite tracking in itself, so as to perform independent initial tracking and automatic tracking using a tracking beam without a control command of the motor control and satellite tracking section that is a main algorithm operating unit and full-electronically controlling an elevation within ±15° and an azimuth within ±5°.

The beam steering control section comprises a central processing unit for controlling beam steering, ROM and RAM for storing a look-up table for beam steering control and algorithms for controlling the satellite tracking, a phase shift controller for performing phase shift control according to control of the central processing unit, a serial communication unit for performing serial communication with the motor control and satellite tracking section, and an AD converter for converting signals from the tracking signal converter and the angular rate sensor into digital data, thereby previously storing data of the phase shift controller in the form of the look-up table in the ROM and directly loading the data in parallel using a data and address bus without depending on operations using the central processing unit.

The motor control and satellite tracking section recognizes a present operation state of the overall antenna system based upon serial data of an initial tracking and iterative tracking status signal and an automatic tracking status signal generated by the beam steering control section.

The motor control and satellite tracking section comprises ROM for storing a satellite tracking algorithm to track the satellite by rotating antenna, a central processing unit for executing the satellite tracking algorithm stored in the ROM, RAM for storing data for the central processing unit to execute a program, a serial communication unit for receiving angular rate sensing signal from the beam steering control section and transmitting the angular rate sensing signal to the central processing unit, the angular rate sensing signal being for motor control, a motor controller for controlling a motor and a driving means for rotating antenna according to a control signal from the central processing unit and transmitting motor state information to the central processing unit, a DIP switch for setting input/output function and initial value, and a LED for displaying operation state.

In another aspect, the present invention provides a method of a vehicle-mounted receive antenna system, comprising steps of (a) initializing of hardware and starting a satellite tracking algorithm if a switch of a beam steering control section is ON and selecting a channel of a satellite tracking signal, (b) checking a system initialization signal (Init) and performing the initial tracking until a satellite signal exceeds a threshold value and a turning absolute angular rate of the antenna becomes stable, (c) performing an automatic tracking mode after the initial tracking is completed, and (d) generating a response flag to change mode into the automatic tracking mode based upon a first signal and a second signal after the initial tracking is completed, and controlling automatically setting the system initialization signal (Init) and the response signal, the first signal containing an elevation angle, a intensity of a received signal at the elevation angle, and a first serial communication interrupt signal that are provided in the step (b), the second signal containing a beam tilt angle in an azimuth direction, a intensity of a received signal at the beam tilt angle, and a second serial communication interrupt signal that are provided in the step (c). The step (d) is performed as an interrupt independent from the steps (a, b, and c). The method is a hybrid tracking method where a tracking in the elevation direction is carried out using an electronic beam and a tracking in the azimuth direction is carried out mechanically.

The step (a) comprises the steps of initializing the beam steering control section and setting up the step (d), selecting a desired channel according to an initializing beam steering control signal if an initial flag is set at 1 (Init=1) according to the step (d), and selecting automatically a predetermined channel if the initializing beam steering control signal is not received.

The step (b) comprises the steps of (b-1) providing a value n=0 to a tracking beam generating phase shifter to control a tracking beam with a central beam after starting an initial and iterative tracking algorithm, (b-2) initializing a location variable I of an elevation angle dividing the elevation angle in a search area into specified angle segments at 0 and sequentially searching beams at predetermined intervals in the elevation direction while data for controlling beam direction is read from a look-up table stored in ROM, (b-3) reading and storing a intensity of a tracking signal into A(0) and providing the intensity of the tracking signal along with a location (i) of a current elevation angle to a motor control and satellite tracking section, (b-4) comparing the signal strength of A(0) with a threshold value (Vth) and checking whether or not the response flag is 1 (R_flag=1), and (b-5) repeating the steps (b-1, b-2, b-3, and b-4) while increasing the location (i) of the elevation angle up to the search area until the A(0) exceeds the threshold value (Vth) and terminating the initial tracking and iterative tracking step if the initialization flag provided by the motor control and satellite tracking section is 1 (Init=1) during the repeated operation.

The step (c) comprises the steps of initializing a location variable (j) in an elevation direction and a location variable (k) in an azimuth direction once the automatic tracking starts, changing a location variable (n) of a tracking beam and storing a strength of each corresponding signal into A(n), comparing a left beam with a right beam and steering the stronger beam in the azimuth direction within a beam steering range (k: 0~14), that is, increasing or decreasing k, comparing an upper beam with a lower beam and steering the stronger beam in the elevation direction within a beam steering range (j: 0~255), that is, increasing or decreasing j, thereby controlling automatic tracking beam steering in full-electronic concept, transmitting subsequently an automatic tracking status (ATAM_Status) to a motor control and satellite tracking control section (STP) over RS232, and comparing a signal intensity of a central beam with a threshold value and terminating the step (c) if the signal strength (A(0)) is smaller than the threshold value (Vth) or if Init=1.

The automatic tracking status signal contains the steering angle variable kaz corresponding to an angle at which an electronic beam is oriented in the azimuth direction, and the motor control and satellite tracking control section (STP) controls a motor using the steering angle variable kaz such that a mechanical tracking error is assumed 0 when a forward direction of the antenna agrees with a pointed angle of a main beam in the azimuth direction and a deviation between them is recognized as a motor tracking error, thus controlling the motor tracking error to be within the beam steering range for satellite tracking control of the antenna.

In another aspect, the present invention provides a satellite tracking control method for vehicle-mounted receive antenna system, comprising steps of (a) initializing hardware input/output, RS232 serial communicating with a beam steering controller, and motor controller, thereby preparing motor control, (b) rotating the motor at 90° absolute angular rate in an azimuth direction for searching a satellite location in the azimuth direction after the step (a), (c) rotating the motor while performing the step (b) until the beam steering controller senses a satellite signal, and stopping the motor when the beam steering controller senses the satellite signal, (d) receiving an output signal of a angular rate sensing means through the beam steering controller, and controlling motor rotating rate for maintaining the motor rotating rate in the steps (b and c) at the angular rate, (e) recognizing stop of the motor and the satellite signal received, executing an automatic satellite algorithm, finding deviation angle kdeg of the azimuth direction by using an automatic tracking status signal (ATAM_status), and executing an automatic tracking algorithm using the deviation angle kdeg in motor control thereby the deviation angle goes to 0, (f) moving an azimuth location left and right slightly for receiving the satellite signal while maintaining the azimuth location by output data of the angular rate sensing means in a case of loosing the satellite signal because of blocking in the step (e), and repeating the step (e), and (g) executing an error processing routine for initialize the all algorithm when an error suddenly occurs in the steps (a, b, c, d, e, and f), repeating the step (b) until the satellite signal is received.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Preferred embodiments of the present invention will now be described in detail with reference to the accompanying drawings.

Figure 1:
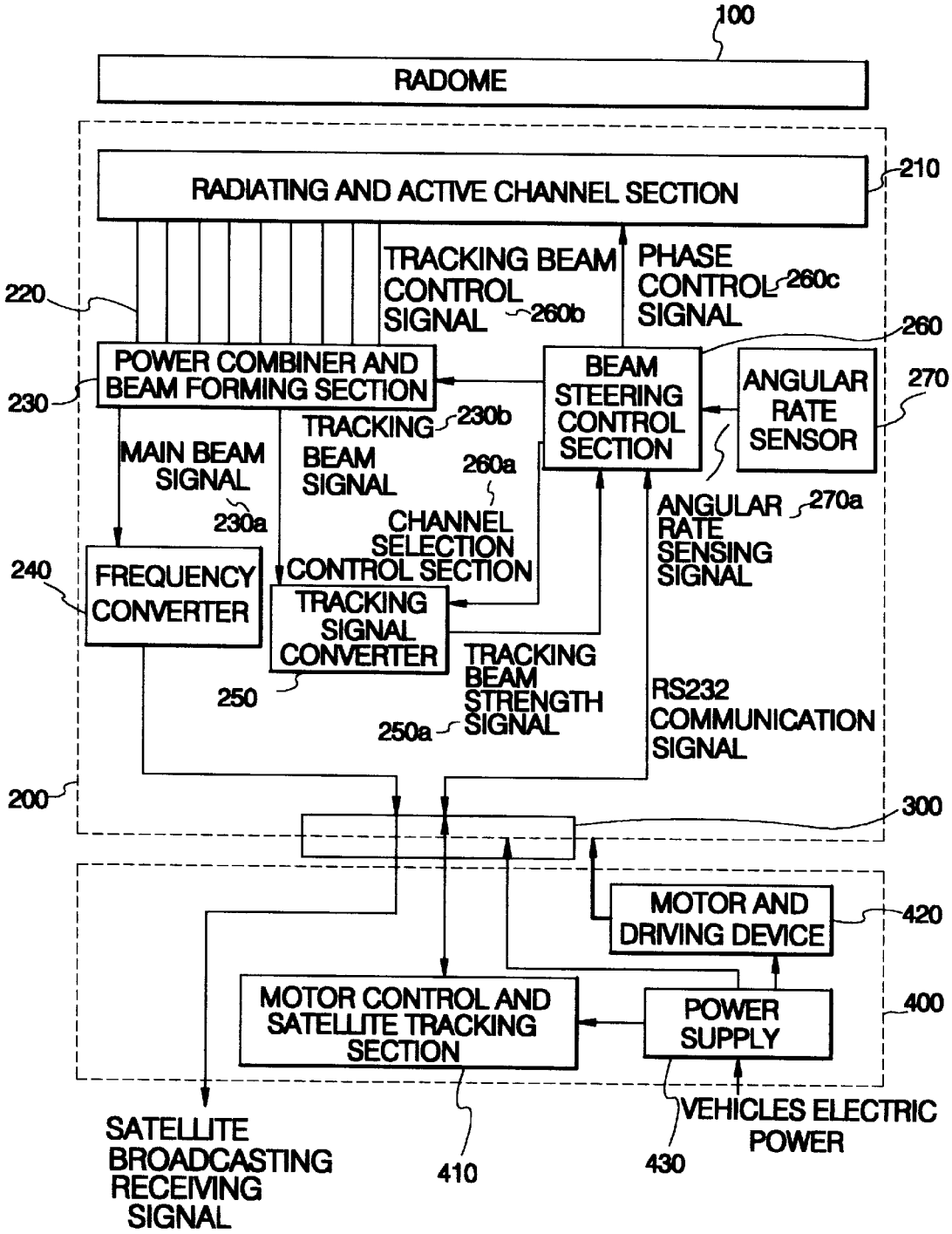
FIG. 1 is a block diagram of a system to which the present invention is applied.

FIG. 1 is a block diagram showing a configuration of a system to which the present invention is applied.

Referring to FIG. 1, the system comprises a radome 100, a rotating part 200, and a fixed part 400. A satellite signal passes the radome 100 and is input to a radiating and active channel section 210. A power combiner and beam forming section 230 receives an output signal 220 from the radiating and active channel section 210 and produces a main beam signal 230*a* and a tracking beam signal 230*b*. The main beam signal 230*a* is converted into a signal of a frequency band suitable for receiving a satellite broadcasting by a frequency converter 240 and output as a satellite broadcasting receiving signal via a rotary joint 300. The tracking beam signal 230*b* is converted into a tracking beam strength signal 250*a* by a tracking signal converter 250 and then input into a beam steering control section 260.

The beam steering control section 260 provides a channel selection control signal 260*a* for selecting a channel, which will be tracked to control a built-in channel selecting tuner, to a tracking signal converter 250. An angular rate sensor 270 senses an absolute angular rate of an antenna rotating part 200 and provides an angular rate sensing signal 270*a* to the beam steering control section 260 in the form of voltage.

Meanwhile, the beam steering control section 260 sends a phase control signal 260*c* to the radiating and active channel section 210 and a tracking beam control signal 260*b* to the power combiner and beam forming section 230. The beam steering control section 260 also communicates with a motor control and satellite tracking section 410 via the rotary joint 300 over RS232 communication signals.

A power supply section 430 receives vehicle's electric power and applies the power to the rotating part 200 via the rotary joint 300 and to a motor and driving device 420 and the motor control and satellite tracking section 410 in the fixed part 400. The motor and driving device 420 for mechanically rotating the antenna rotates the rotating part 200. The rotary joint 300 electrically connects the rotating part 200 to the fixed part 400.

Figure 2:
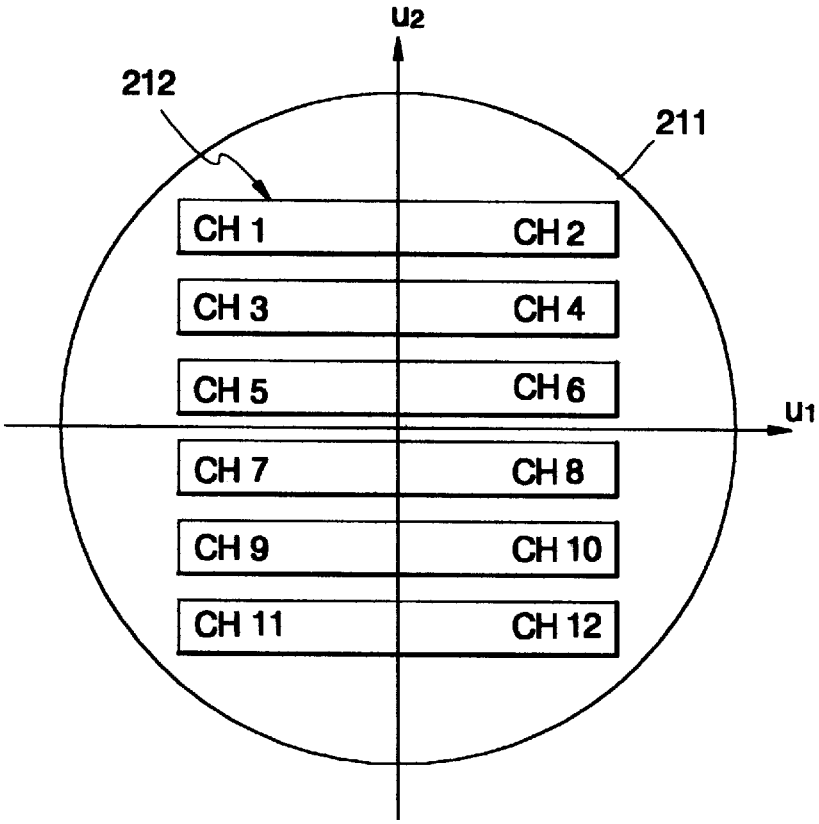
FIG. 2 shows a phased array structure according to the present invention.

FIG. 2, which shows the structure of phased array according to the present invention, is a top plan view of the radiating and active channel section 210 in the system. When the number of radiating and active channel sections 210 is m (for example, 12), CH1 through CH12 show the phased array structure comprising 12 radiating and active channel radiators 212. Each radiating and active channel radiator 212 is mounted to the rotating part 200 through a rotating body structure 211. Two arrows U1 and U2 respectively indicate a side direction or turning direction of the antenna and a forward direction of the antenna.

Figure 3:
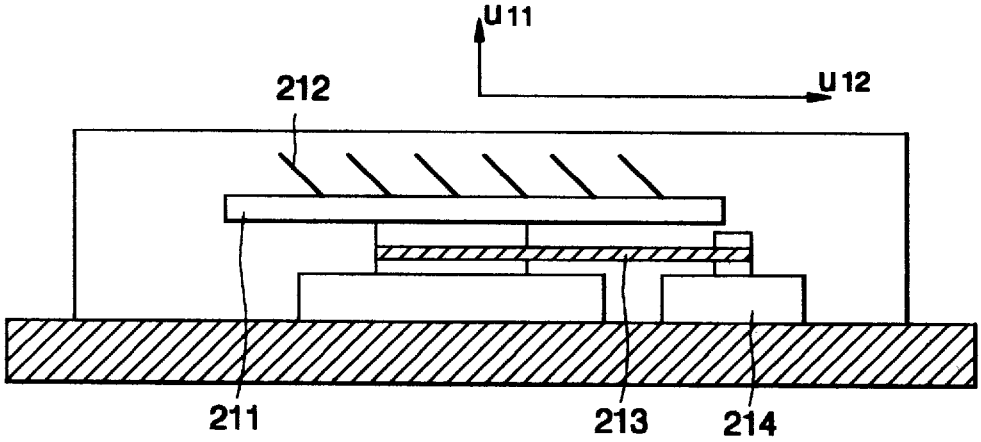
FIG. 3 is a side elevation of FIG. 2.

FIG. 3 is a side elevation of FIG. 2.

There are illustrated the radome 100 and 12 radiators 212 mounted to the respective radiating and active channel sections of CH1 through CH12. The remaining components other than the radiator 212 in the rotating part 200 of FIG. 1 are installed within the rotating body structure 211. The rotating body structure 211 is connected to the fixed part by the rotary joint 300. A belt 213 transfers turning effect from the motor and driving device 214 to the rotating body structure 211, allowing mechanical control. An arrow U12 indicates a forward direction of the antenna and an arrow U11 indicates a vertical direction of the antenna.

Figure 4:
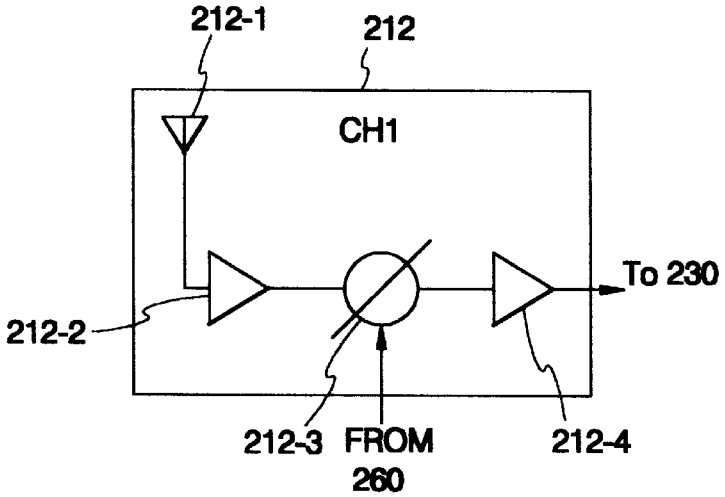
FIG. 4 is a block diagram of the radiating and active channel section depicted in FIG. 2.

FIG. 4 is a block diagram of one of the radiating and active channel sections of CH1 through CH12 depicted in FIG. 2.

A satellite signal is input through a radiator 212-1 and amplified at a low noise amplifier 212-2. The amplified signal passes through a phase shifter 212-3 having a function of delaying a phase and then is amplified at an amplifier 212-4. An output signal of the amplifier 212-4 is provided to the power combiner and beam forming section 230. The amount of delay of the phase shifter is controlled by the phase control signal 260*c* of the beam steering control section 260.

Figure 5:
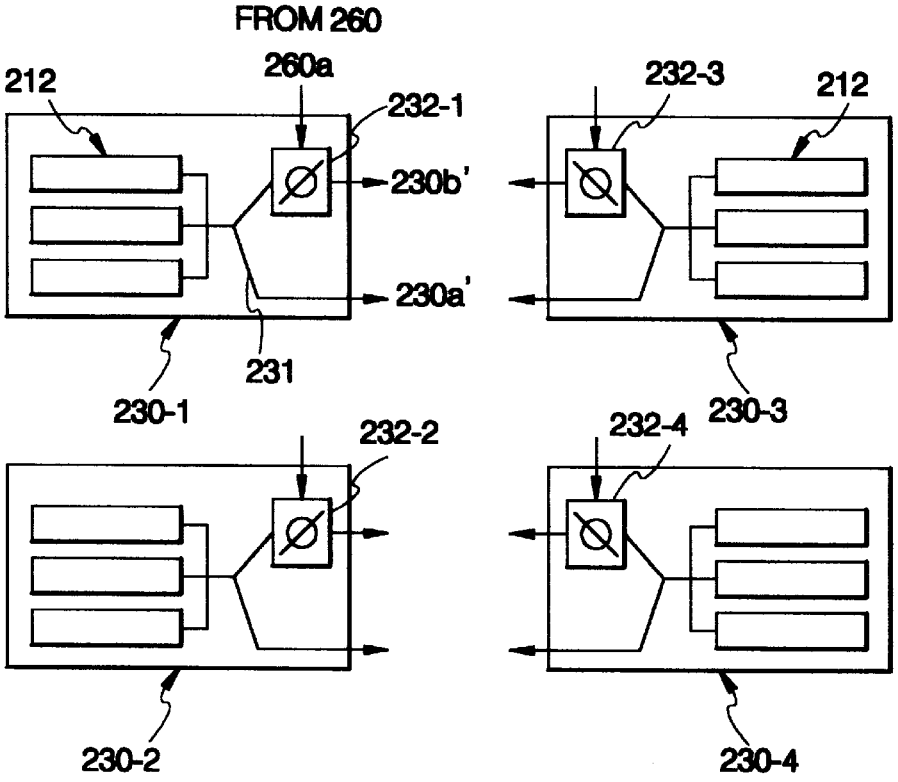
FIG. 5 is a block diagram of the power combiner and beam forming section depicted in FIG. 1.

FIG. 5 is a block diagram of the power combiner and beam forming section 230 depicted in FIG. 1.

Output signals of the radiators 212 of respective radiating and active channel sections 210 are combined by a power combiner 231 and then provided as the tracking beam signal 230*b* via a tracking beam generating phase shifter 232 and as the main beam signal 230*a*. The tracking beam control signal 260*a* of the beam steering control section 260 in FIG. 1 is used for generating a control signal 260*a* for controlling the tracking beam generating phase shifter 232. A signal that is the sum of four main signals 230*a*' of four power combiners 231-1 to 231-4 in FIG. 5 corresponds to the main signal 230*a* of FIG. 1. A signal that is the sum of four tracking beam signals 230*b*' corresponds to the tracking beam signal 230*b* of FIG. 1.

Figure 6:
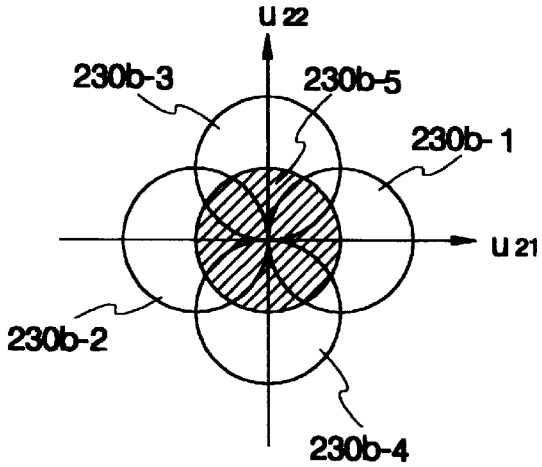
FIG. 6 illustrates conception of types of tracking beams.

FIG. 6 shows different types of tracking beams.

There are a left beam 230*b*-1, a right beam 230*b*-2, an upper beam 230*b*-3, a lower beam 230-4, and a central beam 230*b*-5 generated using four tracking beam generating phase shifter 232-1 to 232-4. Hereinafter, the tracking beam is called an auxiliary beam discriminated from the main beam. An arrow U21 indicates an azimuth direction and an arrow U22 indicates an elevation direction. The tracking signal converter 250 converts the tracking beam signal 230*b* into the tracking beam strength signal 250*a* and provides the tracking beam strength signal 250*a* to the beam steering control section 260, thus allowing the beam steering control section 260 to perform the monopulse tracking using the tracking beams.

Figure 7:
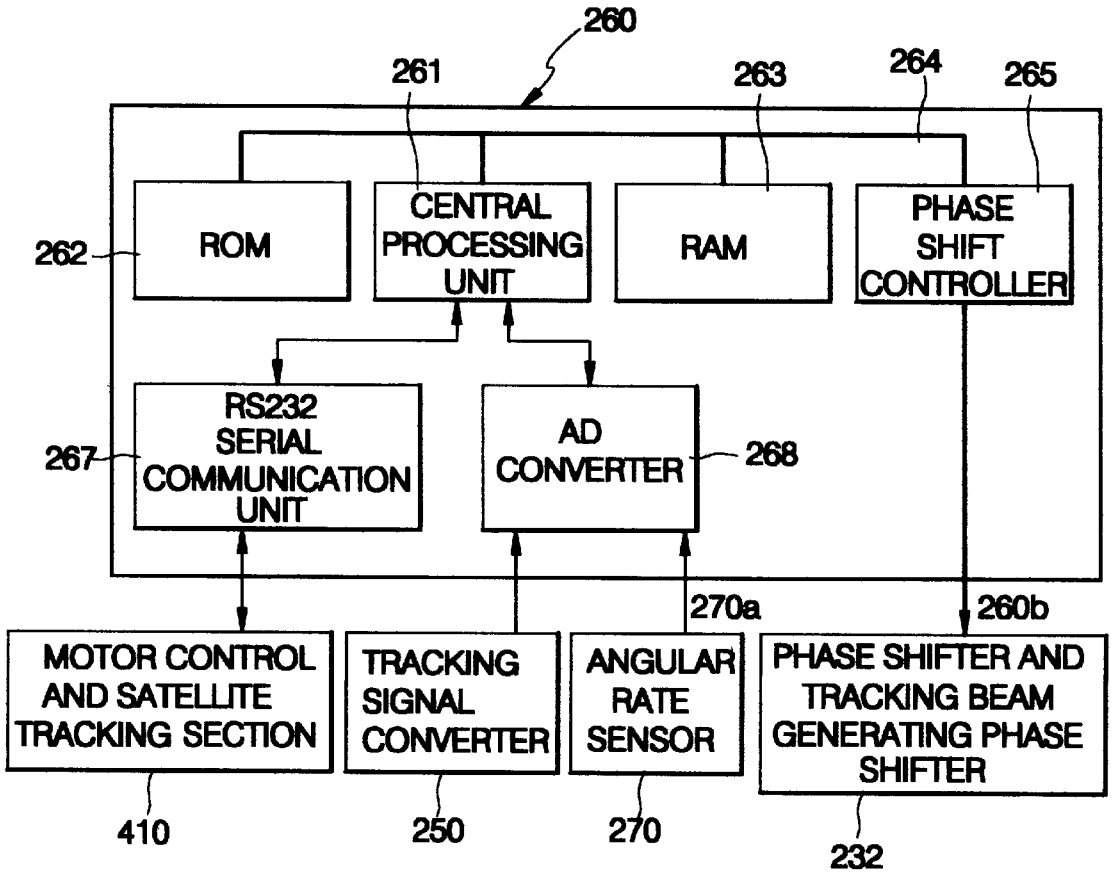
FIG. 7 is a detailed block diagram of the beam steering control section depicted in FIG. 1.

FIG. 7 is a detailed block diagram of the beam steering control section 260 depicted in FIG. 1.

A ROM 262 stores programs and data therein. A central processing unit 261 stores the data and programs in a RAM 263 and then carries out the programs. A phase shift controller 265 performs output (260*b*) in such a manner of performing output to a memory over a data and address bus and controls a phase shifter and tracking beam generating phase shifter 232.

While carrying out the programs, the central processing unit 261 performs serial communication with the motor control and satellite tracking section 410 via an RS232 serial communication unit 267 over serial communication signals. The central processing unit 261 also provides the channel selection control signal 260*a* to the tracking signal converter 250 and receives the tracking beam strength signal 250*a* of the tracking signal converter 250 and the angular rate sensing signal 270*a* of the angular rate sensor 270 via an AD converter 268.

Figure 8:
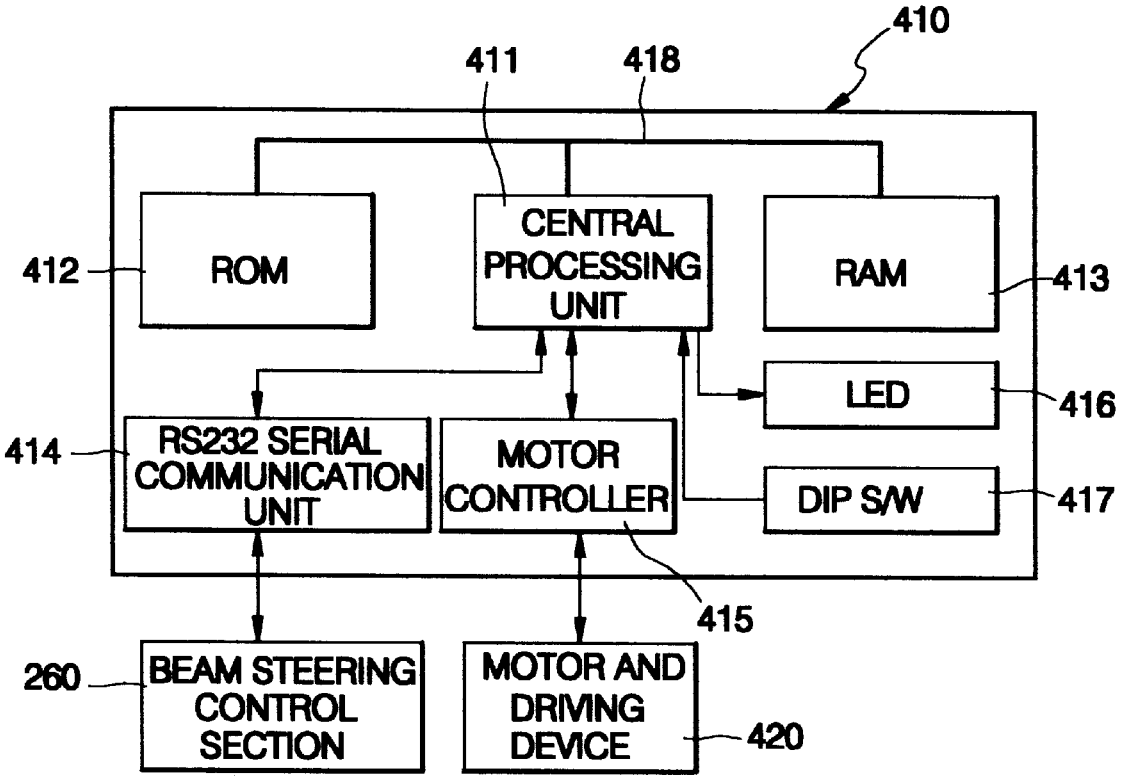
FIG. 8 is a detailed block diagram of the motor control and satellite tracking section depicted in FIG. 1.

FIG. 8 is a detailed block diagram of the motor control and satellite tracking section 410 of FIG. 1.

The motor control and satellite tracking section 410 comprises a ROM 412 for storing a satellite tracking algorithm to track the satellite by rotating antenna, a central processing unit 411 for executing the satellite tracking algorithm stored in the ROM 412, RAM 413 for storing data for the central processing unit 411 to execute a program, a serial communication unit 414 for receiving angular rate sensing signal from the beam steering control section 260 and transmitting the angular rate sensing signal for motor control to the central processing unit 411, a motor controller 415 for controlling a motor and driving device 420 for rotating antenna according to a control signal from the central processing unit 411 and transmitting motor state information to the central processing unit, 411 a DIP switch 417 for setting input/output function and initial value, and a LED 416 for displaying operation state. The central processing unit 411, the ROM 412, and the RAM 413 transmit and receive data through data and address bus 418.

Figure 9:
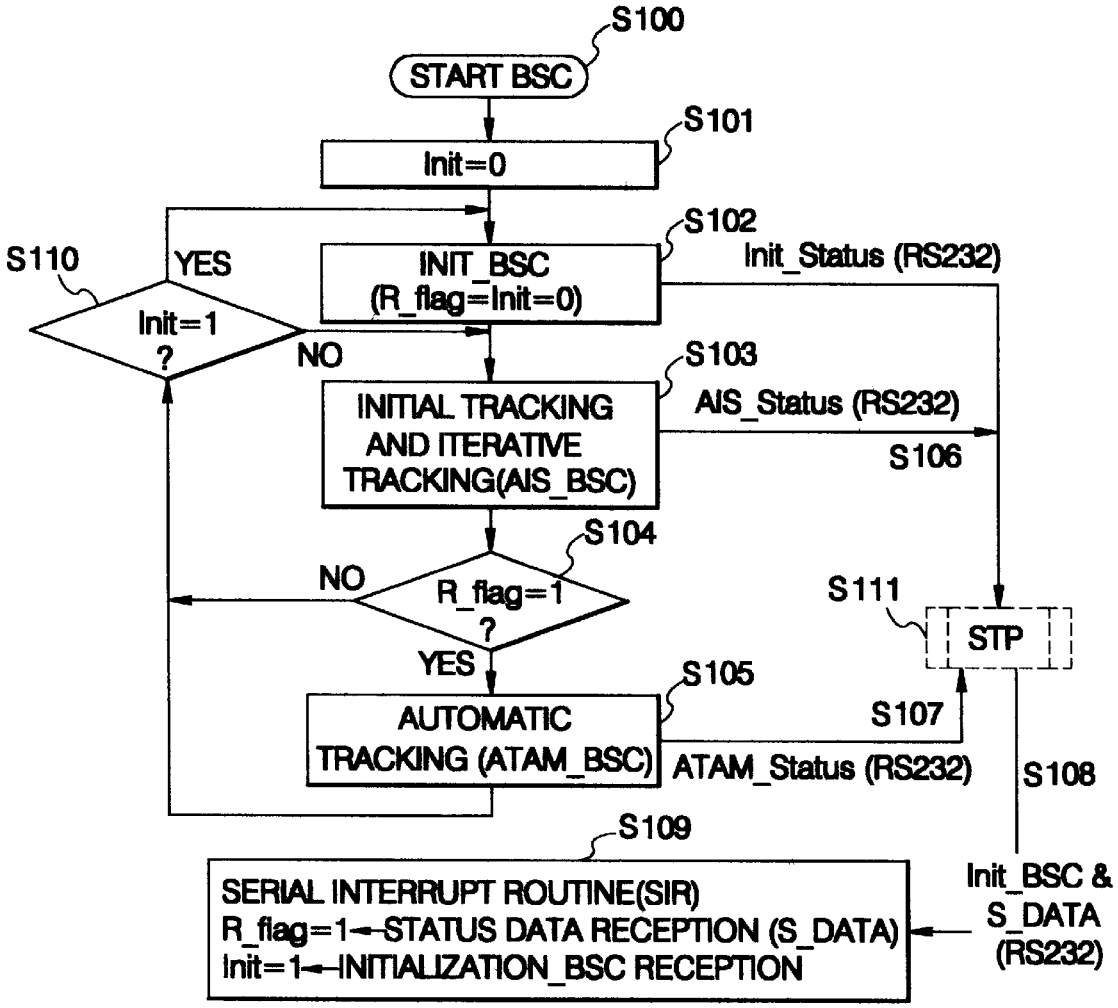
FIG. 9 is an overall flow chart of an algorithm performed by the beam steering control section depicted in FIG. 7.

FIG. 9 is an overall flow chart of a satellite tracking algorithm performed by the beam steering control section depicted in FIG. 7.

The algorithm largely comprises initialization (Init_BSC) (S102), initial and iterative tracking (AIS_BSC) (S103), automatic tracking (ATAM_BSC) (S105), and a serial interrupt routine (S109). Once a switch of the beam steering control section (BSC) 460 is turned ON, initialization is completed in hardware and the algorithm starts (S100). An algorithm reset flag, Init, is initialized at "0" (S101). If the reset flag is "1" , the algorithm re-starts unconditionally. If Init=0, this means that an RS232 signal commanding initialization has not been received from the motor control and satellite tracking section (STP) 410 (S111). At the Init_BSC step (S102), a channel to be a satellite tracking beam signal is selected.

Subsequently, the AIS_BSC is performed (S103). The motor control and satellite tracking section (STP) 410 generates a response flag (Response_flag) when a satellite signal exceeds a threshold value and an absolute angular rate of the antenna is stable (S104). At this time, in the beam steering control section (BSC), the R_flag is set at "1" (S109) and the ATAM_BSC mode is carried out (S105) or the step S110 is carried out. At the step S110, the Init is checked. If the Init is not "1", the AIS_BSC (S103) is carried out. If the Init is "1", the Init_BSC (S102) is carried out.

Meanwhile, statuses are sent to the motor control and satellite tracking section (STP) 410 during the AIS_BSC (S103) and the ATAM _BSC (S105). In case of AIS_Status (S106), the content including an elevation angle (4 bits), a current receiving signal strength at this elevation angle, and a strength of the central beam Sr (4 bits) is sent by 1 byte. In case of ATAM_Status (S107), the content including a 4-bit beam tilt angle (dP(t): within 2 degrees) in the azimuth direction, a current receiving signal strength at this angle, and Sr (4 bits) is sent to the motor control and satelite tracking section (STP) 410.

Separately from the overall flow of the algorithm, one interrupt is effected. This interrupt is the serial interrupt routine (SIR) (S109) operating when the RS232 is received. If upper 4 bits are 0, this signal is the Init_BSC signal. If not, this signal is the Response_flag signal. When the signal is received, the Init or R_flag is automatically set at 1.

Figure 10:
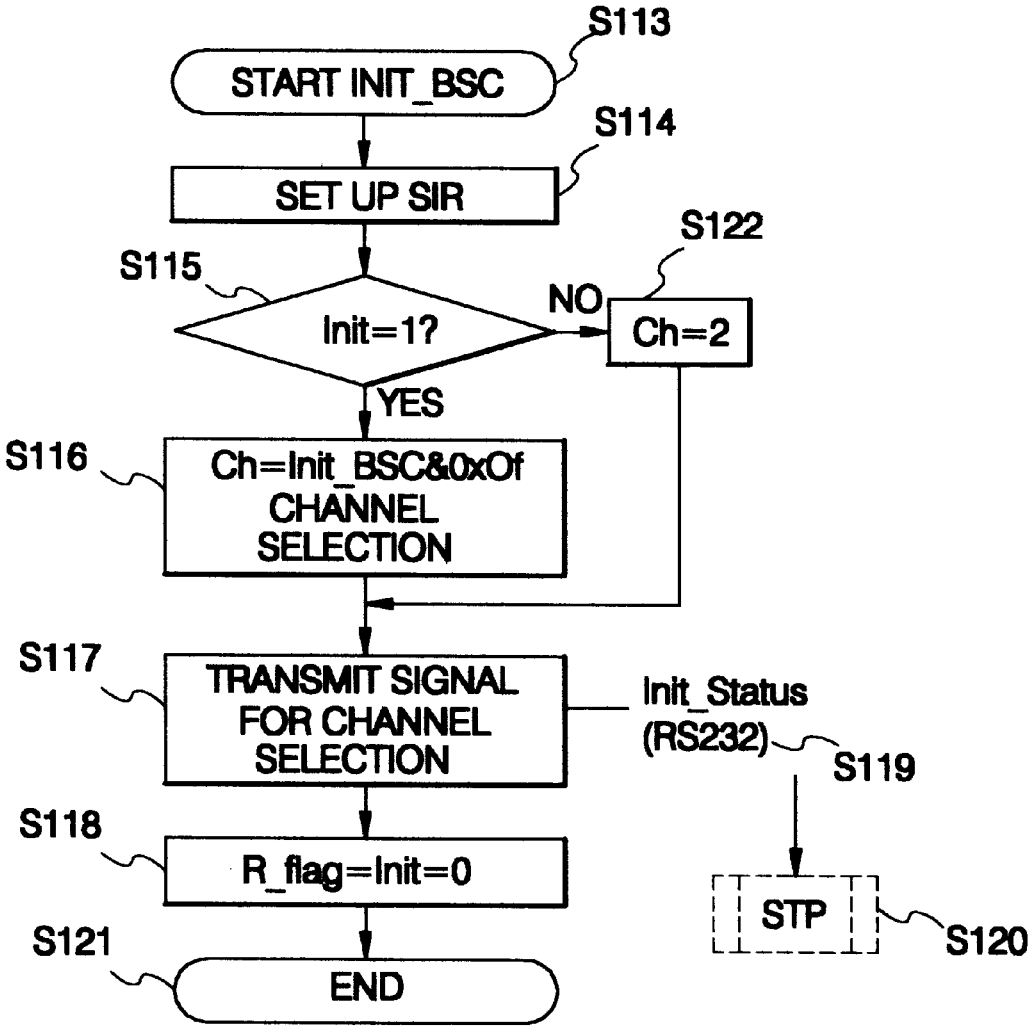
FIG. 10 is a flow chart of INIT_BSC (beam steering control section's initializing algorithm)

FIG. 10 is a flow chart of an algorithm INIT_BSC of initializing the beam steering control section 260.

Once the initialization of the beam steering control section, INIT_BSC, starts (S113), the SIR shown in FIG. 9 is set up (S114). If the Init=1 (S115), a desired channel is selected based upon the lower 4 bits of the Init BSC signal (S108) (S117). If the signal is not received, the channel 2 is automatically selected (S122). Two kinds of signals are received from the motor control and satellite tracking section (STP) 410 (S120). One is the Init_BSC signal (BSC initialization signal) and the other is the Response_flag that is a flag changing the mode from the AIS to the ATAM. When these signals are received, the Init and R_flag are set at "1". Thereafter, the R_flag and Init are initialized (S118) and then the INIT_BSC ends (S121).

Figure 11:
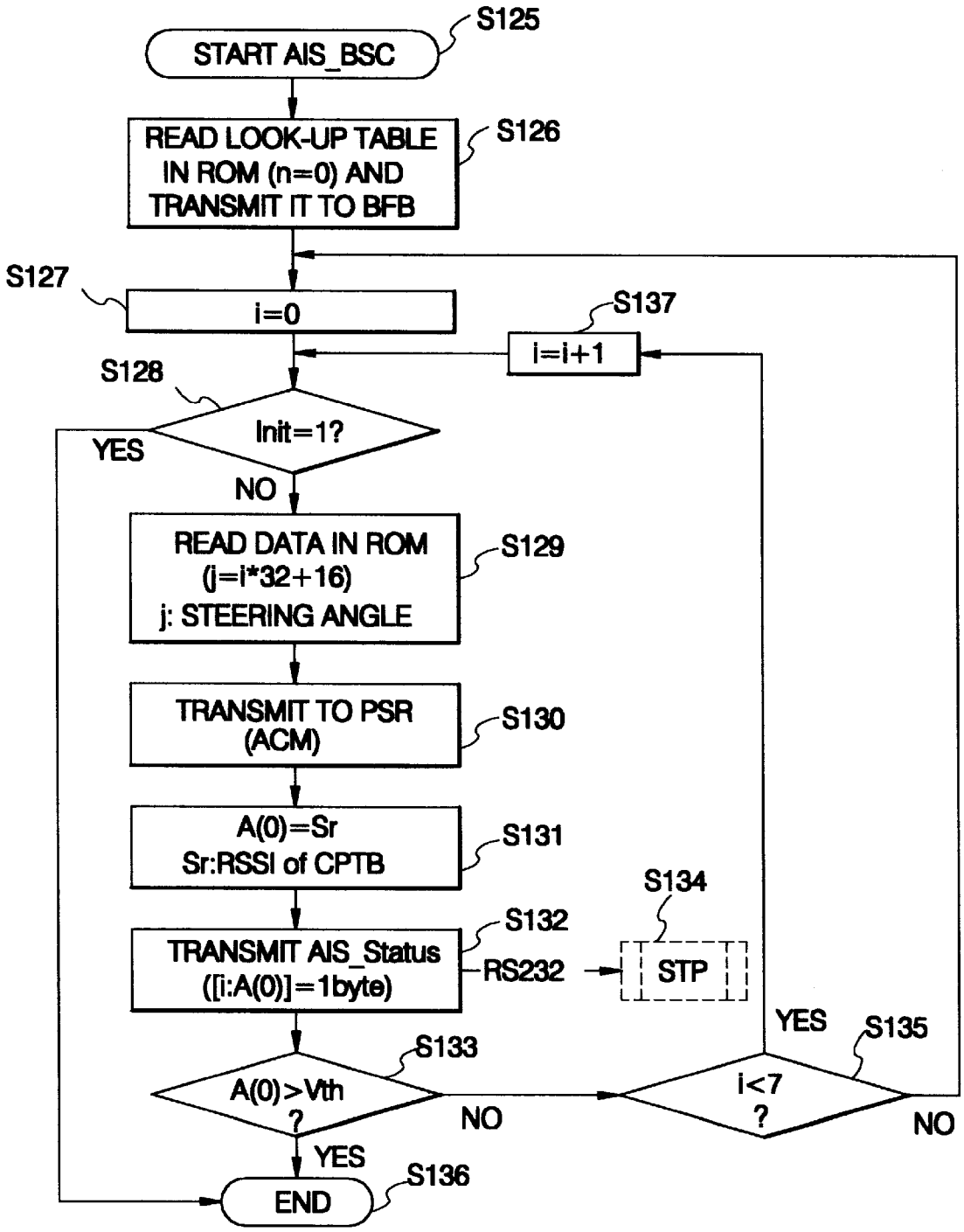
FIG. 11 is a flow chart of AIS_BSC (beam steering control section's initial and iterative tracking algorithm)

FIG. 11 is a flow chart of the beam steering control section's initial and iterative tracking algorithm (INIT_BSC). Once the AIS_BSC starts (S125), a value n=0 is provided to the tracking beam generating phase shifters 232-1 to 232-4 to control the tracking beam with the central beam 230*b*-5 (S126). A location variable i of an elevation angle, dividing the elevation angle in a search area into specified angle segments, is initialized at "0" (S127). Subsequently, beams are sequentially searched at predetermined intervals in the elevation direction (S129). Data for controlling the direction of the beam is read from the ROM 262 and sent to the phase shifter 212-3 within the radiation and active channel section 212 to control the phase shifter 212-3. Thereafter, the strength of a tracking signal is read and stored into A(0) (S131) and then provided as AIS_Status along with a current location i of the elevation angle to the STP (S134) (S132).

The signal strength of the A(0) is compared with a threshold value Vth and it is judged whether or not R_flag=1 (S133). If the A(0) exceeds the threshold value Vth, the AIS_BSC ends (S136). If not, the location i of the elevation angle is increased up to the search area (S135 and S137) and the aforementioned algorithm is repeated. During the repeated operation, if Init=1 (S128), the AIS_BSC ends (S136).

Figure 12:
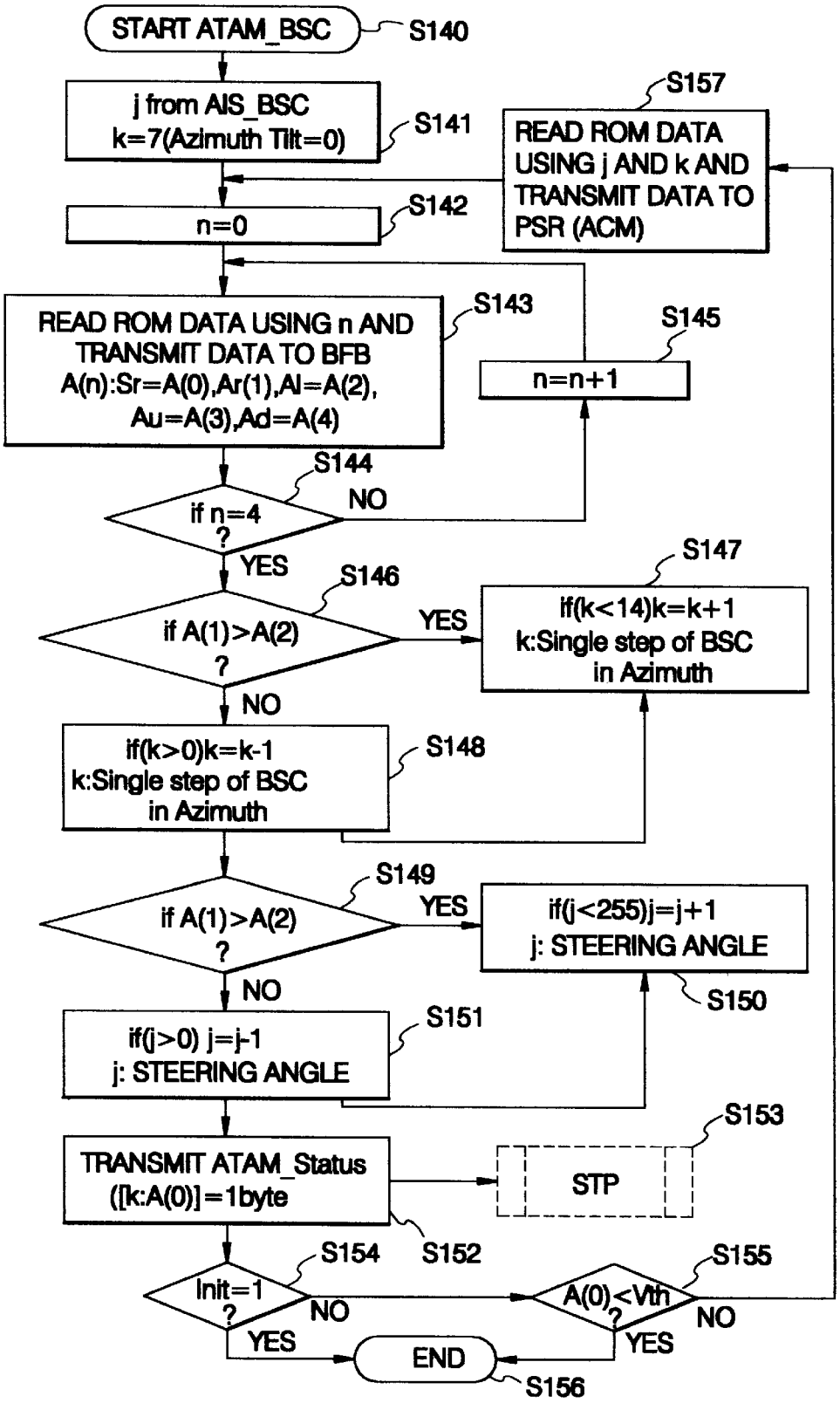
FIG. 12 is a flow chart of ATAM_BSC (beam steering control section's automatic tracking algorithm)

FIG. 12 is a flow chart of the beam steering control section's automatic tracking algorithm, ATAM_BSC.

Once the ATAM_BSC starts (S140), a location variable j in the elevation direction and a location variable k in the azimuth direction are initialized based upon a resultant value of the AIS_BSC (S141). Signal strengths are stored into A(0) to A(n) while changing a location variable n of the tracking beam (S143 to S145). Here, "Ar", "Al", "Au", and "Ad" respectively indicate right, left, upper, and lower beams. "Sr" indicates the strength of the central tracking beam. The left beam and the right beam are compared with each other (S146) and the stronger beam is steered in the azimuth direction within a beam steering range k (e.g., 0 through 14), that is, k is increased or decreased (S147 and S148). Subsequently, the upper beam and the lower beam are compared with each other (S149) and the stronger beam is steered in the elevation direction within a beam steering range j (e.g., 0 through 255), that is, j is increased or decreased (S150 and S151). By doing so, full-electronic automatic tracking beam steering control is accomplished. After carrying out the beam steering control using the tracking beam, the ATAM_Status is sent to the motor control and satellite tracking section (STP) 410 (S153) over RS232 (S152). The signal strength of the central beam is compared with the threshold value0 Vth (S155). If the signal strength (A(0)) is larger than the threshold value Vth or if Init=1 (S154), the ATAM_BSC algorithm ends (S156). Meanwhile, the ATAM_Status contains a steering angle variable kaz at which the electronic beam is directed in the azimuth direction. The motor control and satellite tracking section (STP) 410 (S153) controls the motor using this steering angle variable kaz. When the forward direction of the antenna agrees with an orientation of the main beam in the azimuth direction, it is assumed that an error in mechanical tracking by the motor is 0. The deviation between the forward direction of the antenna and the azimuth orientation of the main beam indicates a tracking error. If the motor tracking error is within the beam steering range, the antenna is allowed to normally perform the satellite tracking. Therefore, this antenna is more excellent in performance of the satellite tracking with beams, as compared with the hybrid antenna that does not perform the beam steering in the azimuth direction.

Figure 13:
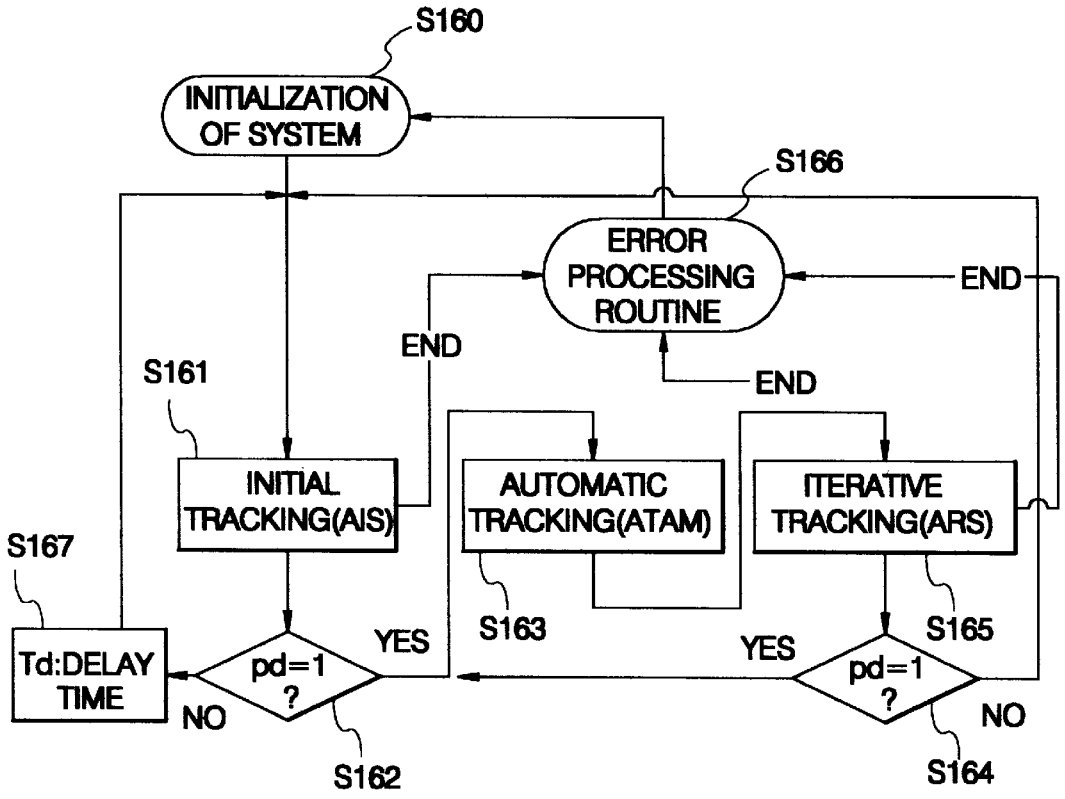
FIG. 13 is an overall flow chart of an algorithm performed by the motor control and satellite tracking section depicted in FIG. 8.

FIG. 13 is an overall flow chart of an algorithm carried out by the motor control and satellite tracking section 410 depicted in FIG. 8.

Once the power is ON, the system is initialized (S160) in such a manner of setting up input-output functions (DIP S/W 417 and LED 416), performing initialization for RS232 serial communication with the beam steering control section (BSC) 260, and initializing the motor controller 415, thereby preparing to control the motor. In the subsequent step of carrying out the initial tracking algorithm AIS (S161), the motor is rotated by about 90° at an absolute angular rate in the azimuth direction to search the position of a satellite in the azimuth direction. At this time, to maintain the absolute angular rate, the motor control and satellite tracking section (STP) 410 receives the output signal of the angular rate sensor in the form of RS232 from the beam steering control section (BSC) 260 and uses the signal for controlling the motor rate. Until the resultant signal of the AIS_BSC is detected, the motor is actuated. On detecting the signal, the motor is stopped. Until the motor is stopped after the signal is detected, an absolute angle should be maintained to hold the azimuth position of the satellite, so the output data of the angular rate sensor 270 that is received via the beam steering control section (BSC) 260 is also used at this time.

After the motor is stopped, the STP becomes to recognize that the signal is caught again through the beam steering control section (BSC) 260 and sends the R_flag signal to the beam steering control section (BSC) 260, thereby allowing the beam steering control section (BSC) 260 to carry out the ATAM_BSC algorithm. The STP calculates a deviation angle k in the azimuth direction based upon the ATAM_Status (S152) received from the beam steering control section (BSC) 260 and uses the deviation angle for controlling the motor. The beam steering control section (BSC) 260 performs the automatic tracking algorithm ATAM to have the deviation angle of 0 (S163). During the ATAM, the signal may be lost due to some causes such as blocking, an iterative tracking algorithm ARS is carried out (S165). At this time, the beam steering control section (BSC) 260 carries out the AIS _BSC. Differently from the AIS, the motor is shaken a little from side to side while maintaining a current position in the azimuth direction based upon the output data of the angular rate sensor 270 in the motor control in accordance with the ARS. If the signal is newly caught (S164), the ATAM is re-performed (S163). When an error suddenly occurs while carrying out the algorithm, an error processing routine is carried out (S166). The algorithm is then initialized (S160). When the signal is not caught for a relatively long time period during the AIS, the AIS is re-performed after a predetermined time.

The present invention having such configuration improves the accuracy of the conventional satellite tracking, thereby compensating for satellite tracking loss and realizing cost effective performance.

The beam steering control section is designed to perform tracking beam control, tracking signal strength detection, phase shifter control, and a self-algorithm for satellite tracking. Therefore, the beam steering control section (BSC) 260 is capable of full-electronically controlling the elevation (e.g., within about ±15°) and the azimuth (e.g., within about ±5°) in itself. This means that the beam steering control section (BSC) 260 may independently carry out the automatic tracking ATAM_BSC (S104) using the initial tracking AIS_BSC (S103) and the tracking beam (in conception of monopulse) without a control command of the motor control and satellite tracking section (STP) 410 that is a main algorithm operating unit, thereby reducing the time necessary for performing the algorithm through communication. According to the present invention, accurate electronic beam steering can be achieved through the serial communication with less traffic, thereby overcoming the defect that the serial communication line should be employed for electrical connection of the rotary joint 300 connecting the rotating part to the fixed part.

The channel selecting function for the tracking beam allows only a desired satellite to be automatically tracked.

Since the data of the phase shift controller 265 for the beam steering is previously stored in the form of a look-up table in the ROM 262 instead of depending on the operations using the central processing unit 261 and then directly written via the data and address bus 264, the structure becomes simple and data can be easily loaded in software, thereby realizing high speed control while using the cheap central processing unit 261.

The motor control and satellite tracking section 410, which is a main algorithm operating unit, has a main function of motor control and do not need to process many operations. The motor control and satellite tracking section 410 recognizes the present operation state of the overall antenna system based upon the serial data output from the beam steering control section 260, that is, AIS_Status (S106) and ATAM_Status (S107). Particularly, the ATAM_Status (S107) includes the steering angle variable kaz corresponding to an angle at which the electronic beam is directed in the azimuth direction. The motor control and satellite tracking section 410 performs the motor control using the steering angle variable kaz. If the motor tracking error is within the beam steering range in the azimuth direction, the antenna performs the satellite search in a normal state. Accordingly, the antenna of the present invention has more excellent performance in tracking a satellite with beams, as compared with the hybrid antenna that does not perform the beam steering in the azimuth direction. To overcome the defects that the motor control is unstable in case of rapid response and is stable in case of slow response, the present invention performs the stable control with a little slower response for the motor control. To compensate for the slowness, the present invention uses rapid full-electronic beam steering in the azimuth direction by the beam steering control section 260. Through such structure, the present invention allows the economical design of the motor and driving device.

As illustrated above, the overall configuration of the system according to the present invention is simpler and more economical than the convention full-electronic system. While the tracking performance of the present invention is similar to that of the full-electronic antenna, the present invention achieves better beam efficiency by arranging radiating elements to be effective in front of the antenna, thereby realizing a high gain antenna. The present invention also solves the problems that cannot be overcome by the mechanical tracking techniques when tracking a satellite in the azimuth direction using the typical hybrid tracking method.

It will be apparent to those skilled in the art that various modifications and variations can be made in the satellite tracking apparatus and control method for vehicle-mounted receive antenna systems of the present invention without deviating from the spirit or scope of the invention. Thus, it is intended that the present invention covers the modifications and variations of this invention provided they come within the scope of the appended claims and their equivalents.

What is claimed is:

1. In a satellite tracking control system for vehicle-mounted receive antenna systems comprising a radome, a rotating part for receiving a satellite signal while rotating for satellite tracking, and a fixed part connected to the rotating part by a rotary joint, for controlling the satellite tracking of the rotating part using a motor control and satellite tracking section for the satellite tracking, said rotating part comprising:

a radiating and active channel section for receiving the satellite signal via the radome;

a power combiner and beam forming section for detecting a main beam signal and a tracking beam signal from an output signal of said radiating and active channel section;

a frequency converter for converting the main beam signal into a signal of a frequency band suitable for reception of satellite broadcasting to provide a satellite broadcasting receiving signal;

a tracking signal converter for detecting a tracking beam strength signal based upon the tracking beam signal;

an angular rate sensor for sensing an absolute angular rate of said rotating part; and a beam steering control section for receiving an angular rate sensing signal, the tracking beam strength signal, and a control signal of said fixed part for motor control and satellite tracking, for generating a channel selection control signal to said tracking signal converter for controlling a tuner for channel selection and for generating a tracking beam control signal to said power combiner and beam forming section and a phase control signal to said radiating and active channel section.

2. The system as claimed in claim 1, wherein said beam steering control section is provided to perform a tracking beam control function, a tracking signal strength detection function, a phase shifter control function, and a satellite tracking function to thereby perform independent initial tracking and automatic tracking using a tracking beam without control command from said motor control and satellite tracking section that is a main algorithm operating unit and full-electronically controlling an elevation within ±15° and an azimuth within ±5°.

3. The system as claimed in claim 1, wherein said beam steering control section comprises:

a central processing unit for controlling beam steering;

a ROM for storing a look-up table for beam steering control and algorithms for controlling the satellite tracking;

a RAM for storing data generated from said ROM;

a phase shift controller for performing phase shift control according to control of said central processing unit;

a serial communication unit for performing serial communication with said motor control and satellite tracking section; and an AD converter for converting signals from said tracking signal converter and said angular rate sensor into digital data, thereby previously storing data of said phase shift controller in the form of the look-up table in said ROM and directly loading data in parallel via a data bus and an address bus without depending on operations using said central processing unit.

4. The system as claimed in claim 1, wherein said motor control and satellite tracking section recognizes an operation state of the overall antenna system based upon serial data of an initial tracking and iterative tracking status signal and an automatic tracking status signal generated by said beam steering control section.

5. The system as claimed in claim 1, wherein said motor control and satellite tracking section comprises:

a ROM for storing a satellite tracking algorithm to track the satellite by rotating antenna;

a central processing unit for executing the satellite tracking algorithm stored in the ROM;

a RAM for storing data obtained from said central processing unit;

a serial communication unit for receiving an angular rate sensing signal from said beam steering control section and transmitting the angular rate sensing signal to the central processing unit for use in motor control;

a motor controller for controlling a motor and driving device for rotating antenna according to a control signal from the central processing unit and transmitting motor state information to the central processing unit;

a DIP switch for setting input/output function and an initial value; and a LED for displaying an operation state.

6. A method of a vehicle-mounted receive antenna system, comprising steps of:

(a) initializing hardware and starting a satellite tracking algorithm if a switch of a beam steering control section is ON and selecting a channel of a satellite tracking signal;

(b) checking a system initialization signal and performing an initial tracking until a satellite signal exceeds a threshold value and a rotation absolute angular rate of the antenna becomes stable;

(c) performing an automatic tracking mode after said initial tracking is completed; and (d) generating a response flag to change mode into the automatic tracking mode based upon a first signal and a second signal after said initial tracking is completed, and controlling automatically setting the system initialization signal and the response signal, the first signal containing an elevation angle, an intensity of a received signal at the elevation angle, and a first serial communication interrupt signal that are provided in said step (b), the second signal containing a beam tilt angle in an azimuth direction, an intensity of a received signal at the beam tilt angle, and a second serial communication interrupt signal that are provided in said step (c), wherein said step (d) is performed as an interrupt independent from said steps (a, b, c), and wherein said method is a hybrid tracking method where a tracking in the elevation direction is carried out using an electronic beam and a tracking in the azimuth direction is carried out mechanically.

7. The method as claimed in claim 6, wherein said step (a) comprises the steps of:

(a-1) initializing the beam steering control section and setting up said step (d);

(a-2) selecting a desired channel according to an initializing beam steering control signal if an initial flag is set at 1 (Init=1) according to said step (d); and (a-3) selecting automatically a predetermined channel if the initializing beam steering control signal is not received.

8. The method as claimed in claim 6, wherein said step (b) comprises the steps of:

(b-1) providing a value 0 to a tracking beam generating phase shifter to control a tracking beam with a central beam after starting an initial and iterative tracking algorithm;

(b-2) initializing a location variable of an elevation angle to divide the elevation angle in a search area into specified angle segments at 0 and sequentially searching beams at predetermined intervals in the elevation direction while data to control beam direction is read from a look-up table;

(b-3) reading and storing an intensity of a tracking signal into address 0 and providing the intensity of the tracking signal along with a location of a current elevation angle to a motor control and satellite tracking section;

(b-4) comparing the signal strength of address 0 with a threshold value (Vth) and checking whether or not the response flag is 1 (R_flag=1); and (b-5) repeating the steps (b-1, b-2, b-3, and b-4) while increasing the location (i) of the elevation angle up to the search area until the A(0) exceeds the threshold value (Vth) and terminating said initial tracking and iterative tracking step if the initialization flag provided by the motor control and satellite tracking section is 1 during the repeated operation.

9. The method as claimed in claim 6, wherein said step (c) to comprises the steps of:

(c-1) initializing a location variable in an elevation direction and a location variable in an azimuth direction once the automatic tracking starts;

(c-2) changing a location variable of a tracking beam and storing a strength of each corresponding signal into address n;

(c-3) comparing a left beam with a right beam and steering the stronger beam in the azimuth direction within a beam steering range;

(c-4) comparing an upper beam with a lower beam and steering the stronger beam in the elevation direction within a beam steering range, thereby controlling automatic tracking beam steering in full-electronic concept;

(c-5) transmitting subsequently an automatic tracking status signal to a motor control and satellite tracking control section; and (c-6) comparing a signal intensity of a central beam with a threshold value and terminating said step (c) if the signal strength in address 0 is smaller than the threshold value or if the initialization flag is 1.

10. The method as claimed in claim 9, wherein said automatic tracking status signal contains a steering angle variable (kaz) corresponding to an angle at which an electronic beam is oriented in the azimuth direction, and wherein said motor control and satellite tracking control section controls a motor using said steering angle variable (kaz) such that a mechanical tracking error is assumed to be 0 when a forward direction of the antenna agrees with a pointed angle of a main beam in the azimuth direction and a deviation between them is recognized as a motor tracking error, thus controlling the motor tracking error to be within the beam steering range for satellite tracking control of the antenna.

11. A satellite tracking control method for vehicle-mounted receive antenna system, comprising steps of:

(a) initializing hardware input/output, RS232 serial communicating with a beam steering controller, and a motor controllers for motor control;

(b) rotating a motor at 90° absolute angular rate in an azimuth direction for searching a satellite location in the azimuth direction after step (a);

(c) rotating the motor while performing step (b) until the beam steering controller senses a satellite signal, and stopping the motor when the beam steering controller senses the satellite signal;

(d) receiving an output signal of an angular rate sensor through the beam steering controller, and controlling the motor to maintain a motor rotating rate in said steps (b and c) at the angular rate;

(e) recognizing stop of the motor and the satellite signal received, executing an automatic satellite algorithm, determining a deviation angle (kdeg) of the azimuth direction by using an automatic tracking status signal, and executing an automatic tracking algorithm using the deviation angle (kdeg) for motor control;

(f) moving an azimuth location left and right slightly for receiving the satellite signal while maintaining the azimuth location by output data of said angular rate sensor when loosing the satellite signal because of blocking in said step (e), and repeating said step (e); and (g) executing an error processing routine for initialize said all algorithms when an error suddenly occurs in said steps (a, b, c, d, e, and f), repeating said step (b) until the satellite signal is received.

12. The system as claimed in claim 1, wherein said radiating and active channel section comprises:

a radiator which radiates the satellite signal via the radome;

a first amplifier which amplifies the satellite signal to produce an amplified satellite signal;

a phase shifter which delays a phase of the amplified signal in accordance with the phase control signal to produce a phase-delayed satellite signal; and a second amplifier which amplifies the phase-delayed satellite signal to produce the output signal to said power combiner and beam forming section.

13. The system as claimed in claim 1, wherein said beam steering control section comprises:

a central processor which controls beam steering functions;

memory devices which store a look-up table for beam steering control functions and algorithms for controlling satellite tracking;

a phase shift controller which generates the phase control signal under control of said central processor;

a serial communication unit which establishes serial communication with said motor control and satellite tracking section for satellite tracking; and an A/D converter which converts signals from said tracking signal converter and said angular rate sensor into digital data for enabling said central processor to generate the channel selection control signal and the tracking beam control signal.

14. The system as claimed in claim 1, wherein said motor control and satellite tracking section comprises:

memory devices which store a satellite tracking algorithm to track the satellite by rotating the antenna and related data;

a central processor which executes the satellite tracking algorithm to track the satellite by rotating the antenna;

a serial communication unit which transmits an angular rate sensing signal from said beam steering control section to said central processor for motor control;

a motor controller for controlling a motor and driving device to rotate the antenna under control of said central processor;

a DIP switch for setting input/output functions and an initial value; and a light-emitting diode (LED) for displaying an operation state of said motor control and satellite tracking section.

* * * * *